United States Patent [19]

Borgeaud et al.

[11] 4,306,904

[45] Dec. 22, 1981

[54] PROCESS OF INTRODUCING A SOLID ADDITION INTO A BATH OF LIQUID METAL

[75] Inventors: Pierre Borgeaud; Andre Vilain, both of Le Fayet, France

[73] Assignee: Societe Francaise d'Electrometallurgie Sofrem, Paris, France

[21] Appl. No.: 27,984

[22] Filed: Apr. 6, 1979

Related U.S. Application Data

[63] Continuation of Ser. No. 840,524, Oct. 11, 1977, abandoned.

[51] Int. Cl.[3] ..... C22C 33/08

[52] U.S. Cl. ..... 75/130 B; 75/58; 75/67 A; 75/68 R; 75/93 G; 75/142; 75/143; 75/256

[58] Field of Search ..... 75/130 R, 130 A, 130 AB, 75/130 B, 130 BB, 130, 256, 53–58, 68 R, 67 A, 93 G, 142, 143

[56] References Cited

U.S. PATENT DOCUMENTS

| | | | |
|---|---|---|---|
| 2,978,765 | 4/1961 | Brown | 75/58 |
| 3,681,051 | 8/1972 | Takashima et al. | 75/256 |
| 3,717,456 | 2/1973 | Percheron et al. | 75/130 B |
| 3,765,875 | 10/1973 | Septier et al. | 75/130 R |
| 3,917,240 | 11/1975 | Tanoue et al. | 75/58 |

FOREIGN PATENT DOCUMENTS

| | | | |
|---|---|---|---|
| 883625 | 11/1958 | United Kingdom | 75/58 |
| 883853 | 12/1961 | United Kingdom | 75/58 |

*Primary Examiner*—M. J. Andrews
*Attorney, Agent, or Firm*—McDougall, Hersh & Scott

[57] ABSTRACT

A process for introducing into a metal bath an additive in the form of a solid shaped in the form of an elongate body portion having at least two vanes extending outwardly therefrom for a distance of not more than 40 mm with the vanes dimensioned and spaced one from the other to avoid interlocking thereby to enable the desired effect to be derived from the addition as rapidly as possible, including the shaped additive and method.

10 Claims, 10 Drawing Figures

PROCESS OF INTRODUCING A SOLID ADDITION INTO A BATH OF LIQUID METAL

This is a continuation of application Ser. No. 840,524, filed Oct. 11, 1977, now abandoned.

The present invention relates to a process of introducing into a bath of liquid metal, a solid addition of metal, alloy or reactive substance, in a form intended to expedite dissolution thereof, such for example as the case of an addition whose density is below that of the liquid metal or metal alloy and which is required to produce virtually its entire effect during the period of time required for the additive to rise to the surface of the bath from the point of its release in the bath, preferably at the bottom of the bath.

This is the case, for example, when magnesium or alloys based on magnesium and silicon are to be introduced into liquid cast iron, or when silicon and/or magnesium is to be introduced into a bath of liquid aluminum to produce an alloy, or when refining fluxes are to be introduced into aluminum or magnesium, or when mischmetal is to be introduced into liquid steel for desulphurization thereof.

It has been current practice to modulize cast irons by means of alloys, often based on Fe-Si, containing magnesium as a nodulizing agent. The use of such alloys has the advantage, over introducing pure magnesium, of better distribution of the active element and much less violent reactions, irrespective of the method of introduction used.

Hereinafter, the term "treatment alloys" will be used to denote all the alloys which are usually employed for nodulization and/or inoculation of casting metals, simultaneously or sequentially.

The experience acquired in smelting indicates that observation of granulometric tolerances of the treatment alloys, irrespective of their composition, is an important factor in success of the operation. Excessively fine granulometry causes violent and short reaction with rapid volatilization of magnesium of the alloy. Excessively coarse granulometry results in a slow reaction, with the danger that the larger pieces will rise to the surface, where they will burn upon contact with the air, without having had the time to dissolve in the liquid metal before they rise to the surface, thus resulting in a loss of product and a low degree of nodulization efficiency.

It has been found that the ideal granulometry is between 10 and 30 mm, these figures expressing the mean dimensions of the crushed pieces which are of a slightly irregular shape.

It is difficult constantly to maintain this granulometric distribution. It depends, on the one hand, on the fragility of the alloy, which itself depends on the composition and its cooling speed, and, on the other hand, on the grinding, crushing and screening means used. In any event, it is practically impossible to avoid the production of a substantial amount of fines smaller than 10 mm, which must be recycled by re-melting; furthermore, in the course of transportation of the calibrated material, more fine particles are produced, and the material tends to separate out according to size, with the largest pieces occupying the upper part of the packages. The user of this material, who does not take the precaution intimately to re-mix the contents of the unitary packages, finds that this results in very noticeable differences in reactivity between the material which is taken from the top, the middle and the bottom of the packages. Similar problems arise, for example, when mischmetal is to be added to a steel bath, for desulphurization thereof.

To overcome these disadvantages, applicants envisaged making the treatment alloys into the form of particles of a constant volume and therefore a constant weight, by casting in molds and in particular in sand molds. However, it was found that geometrically simple shapes such as parallelepipeds or truncated cones were not yielding good results, because of an insufficient surface-to-volume ratio, and, thus, an insufficient degree of reactivity; the alloy, whose density is always below that of the casting metal, because of the presence of magnesium and in most cases silicon, rises to the surface of the liquid bath where it burns, before it is capable of being dissolved in the liquid bath. Conversely, geometrical shapes having a large developed surface, in particular with deep vanes or channels, give rise to three kinds of difficulties:

difficulty in making the sand molds which have thin zones, the fragility of the fine parts which break, either when removing the sand after removal from the mold, or during handling and transportation, which results in fine waste, and the disadvantages already described above, excessive reactivity, which results in splashing and excessively rapid escape of magnesium, with the result of insufficient nodulization of the graphite.

In accordance with the practice of this invention, applicants have found that it was possible to reconcile the following requirements:

ease of molding and removal of the case members from the molds, ease of removing sand, upon removal from the mold, regular reactivity, producing total nodulization of the graphite, without losses by splashing or combustion, lack of fragility, for handling and transportation, absence of separating out, upon transportation.

In accordance with the practice of this invention, the treatment alloy is provided in the form of blocks which are characterized by: a central body of elongate shape, having at least two vanes fixed along the central body, no point of the member being more than 40 mm and preferably 10 mm from the outside surface, and by as high a surface-to-surface volume ratio as possible, and it is an object of this invention to provide a method and means for accomplishing the above.

In addition, the vanes of a given block must not be capable of being stably inserted into the gap formed by the vanes of another block, said gap being, for this purpose, substantially larger or smaller than the maximum width of said vanes.

In order to facilitate making the mold from a pattern, and removing the blocks of treatment alloy from the mold, it is preferable that the blocks are inscribed in a truncated cone whose angle of conicity is determined in known manner by the foundry expert, so as to ensure that there is a suitable taper.

Finally, it may be advantageous for the blocks of treatment alloy to have a unit weight which is a complete multiple or a sub-multiple of the kilogram, so that, if necessary, weighing of the blocks can be dispensed with and replaced by a simple counting operation, when the blocks are to be used. The block, in the form of a truncated cone with vanes, makes it possible in practice to achieve a very high surface-to-volume ratio, taking into consideration the technological requirements as regards molding.

The method of carrying out the invention will be described in greater detail with reference to the drawings and the following example.

Treatment alloy of the type described in French Pat. No. 2,087,003, having the following composition:

| | |
|---|---|
| Si | 47.8% |
| Mg | 9.1% |
| Ba | 4.6% |
| Ca | 0.50% |
| Al | 0.18% |
| N | 0.47% |
| Fe | to make up to 100%, |

is formed into blocks weighing from 165 to 170 g. It can be assumed, within an acceptable margin of error, that six of these blocks weigh about 1 kg. Using the same shape, it is also possible to have blocks which individually weigh 500 grams or 2 kg.

The cone angle is about 10°.

Irrespective of the manner in which the blocks come into contact, it will be seen from FIGS. 5 to 9 that they will not fit together in a stable manner. If it were otherwise, there would be the danger that, after the shaking caused by transportation over a long distance, the blocks would cling together in groups, which would make them difficult to handle and which would have the same disadvantage, from the point of view of reactivity, as solid blocks.

Figure 6:
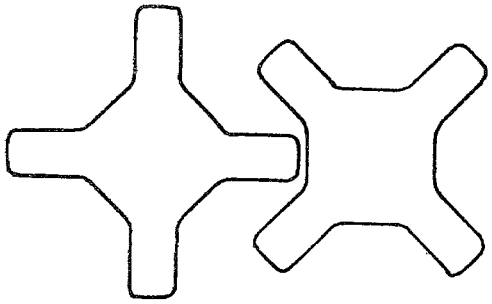
Figure 7:
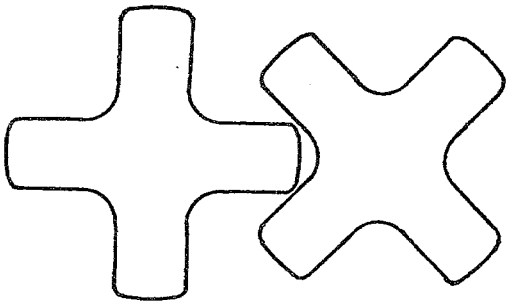
Figure 8:
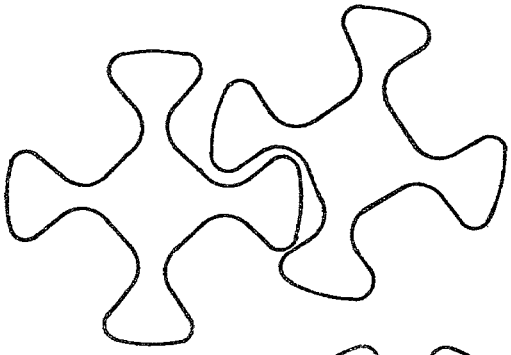
Figure 9:
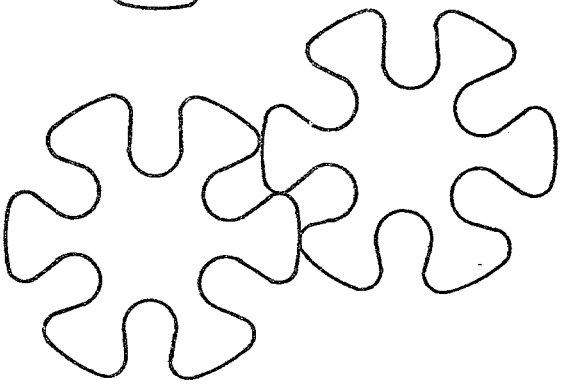

FIGS. 1 to 9 show different forms of vanes in accordance with the invention, which cannot become interengaged because the maximum width of the vanes is greater than the distance which separates them, in the case of FIG. 9, and smaller than said separating distance, in the case of FIGS. 6, 7 and 8.

Figure 10:
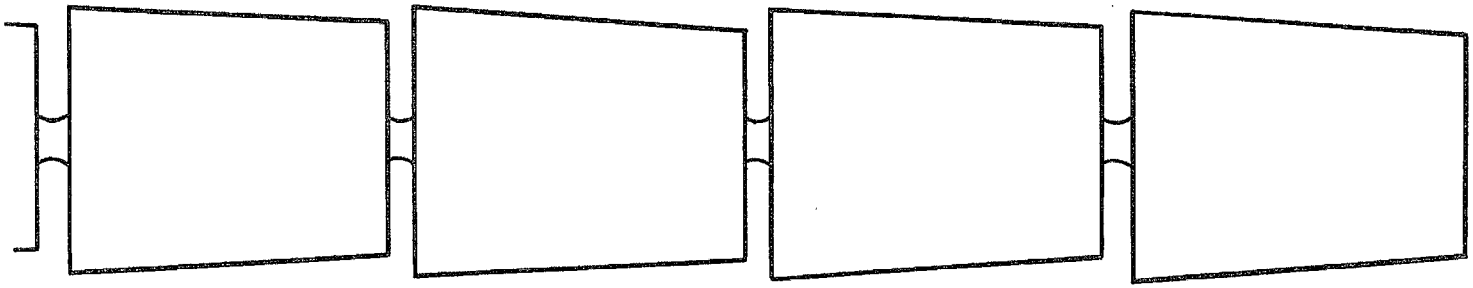
FIG. 10 is a longitudinal view showing a string of four identical blocks having four vanes, the blocks being cast in a single operation with a construction forming a weak point at which the blocks may be separated one from the other.

These blocks of different shapes can be produced by known methods, such as sand casting. It is possible either to cast individual blocks or, preferably, clusters comprising a plurality of blocks which are aligned along their main axis, as illustrated in FIG. 10, the blocks having between them a constricted portion to provide points of weakness at which the blocks are to be separated. After removal from the mold, the blocks are cleaned of sand in known manner, for example in a wet polishing drum which itself contains a certain amount of sand or media which absorbs inpact of the blocks one against each other and against the walls of the drum, when the drum is rotated, thereby minimizing the danger of breaking some vanes.

Figure 1:
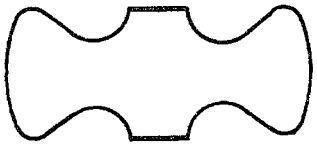
FIG. 1 is a sectional view taken half-way up its height, of a block of treatment alloy, provided with two vanes.
Figure 2:
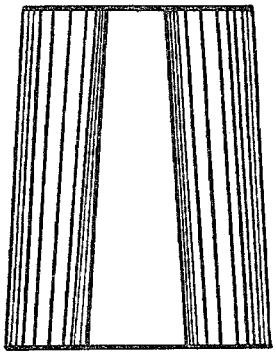
FIG. 2 is a longitudinal section of the block shown in FIG. 1.
Figure 3:
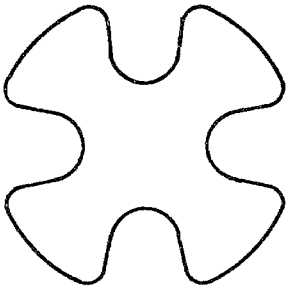
FIG. 3 is a sectional view taken half-way up the height, of a block of treatment alloy, provided with four vanes, in a form generally similar to that of a four-leafed clover.
Figure 4:
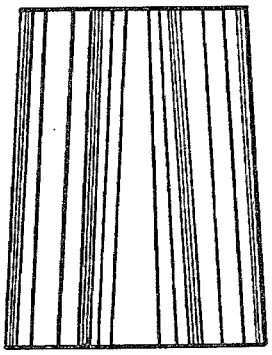
FIG. 4 is a longitudinal section of the block shown in FIG. 3.
Figure 5:
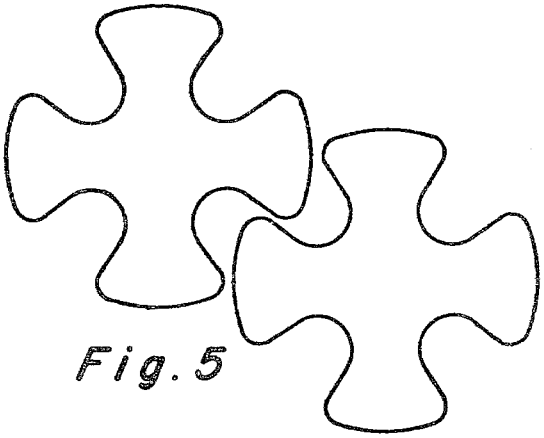
FIGS. 5 to 9 are sectional views intended to show that it is impossible for the vanes of one block to be engaged into the grooves of another block.

EXAMPLE 8 kg of a nodulizing alloy having the chemical composition set out above, was prepared by sand casting, in a form having four vanes corresponding to those of FIGS. 3 and 4, the components having an individual weight varying from 162 to 170 grams. These 8 kg of alloy (i.e. 48 individual components) were placed at the bottom of a casting ladle, covered with a few kilograms of scrap iron waste, and 600 kg of liquid cast iron was poured into the ladle. The reaction began after about 10 seconds and lasted for about a minute, without violence or splashing.

The cast iron produced had entirely satisfactory features:

| | | |
|---|---|---|
| proportion of ferrite: | 90% | evaluation by micrographic examination |
| proportion of perlite: | 9.9% | |
| proportion of carbides: | 0.1% | |
| breaking load: | 49.6 hb | |
| elongation to rupture: | 20.7% | |
| proportion of Mg: | 0.066% | (i.e. a yield of 54% in respect of Mg introduced with the alloy) |

The invention is applied not only to the introduction of nodulizing or inoculating alloys into cast iron, but also for problems as regards dissolution, in general, such as:

addition of aluminum to steel, addition of a treatment flux to aluminum, addition of magnesium or silicon or a master alloy to an aluminum bath, addition of mischmetal to steel, post-inoculation of cast iron or nodulization action in the mold (the so-called "in-mold" process).

We claim:

1. A process for dissolution into a bath of liquid metal or alloy an additive in the form of a solid from which an effect is desired to be provided by dissolution as rapidly as possible comprising providing the additive as shaped solids having a density below that of the liquid metal of the bath and having an elongate solid body portion which is tapered from one end to the other throughout its length with at least two vanes extending perpendicularly outwardly from the central body portion from equally spaced apart portions of the central body portion and continuously throughout the length thereof said vanes having a width greater than the spacing between adjacent vanes such as to avoid interlock between a vane of one solid and the void between adjacent vanes of an adjacent solid and thereby to provide a block which is less fragile and which maximizes surface to surface for dissolution, positioning the solid in the bottom portion of the bath, and releasing the solid in the bottom portion of the bath to enable the solid to rise through the bath for dissolution during its rise through the bath.

2. A process as claimed in claim 1 in which the vanes extend outwardly from the body portion for a distance which does not exceed 10 mm.

3. A process as claimed in claim 1 in which the additive is introduced into the bottom portion of the bath and virtually its entire effect is derived during the rise of the additive through the bath.

4. The process as claimed in claim 1 in which the metal bath is liquid cast iron and the additive introduced into the bath is an alloying material containing a metal selected from the group consisting of iron, silicon and magnesium.

5. The process as claimed in claim 1 in which the metal of the bath is liquid steel and the additive is mischmetal for desulphurization of the steel.

6. The process as claimed in claim 1 in which the metal of the bath is liquid aluminum and the additive is magnesium and/or silicon.

7. The process as claimed in claim 1 in which the shaped solids are of relatively uniform weight corresponding to a multiple or sub-multiple of a unit weight to enable calculation of the amount of addition by counting instead of weighing.

8. A process as claimed in claim 1 in which each of the vanes extend from the body portion for a distance that does not exceed 40 mm.

9. A process as claimed in claim 1 in which the central body portion is in the form of an elongate tapered solid.

10. A process as claimed in claim 1 in which the truncated central body portion has a taper of about 10° substantially throughout the length thereof.

* * * * *